US006106017A

United States Patent [19]

Johnson

[11] Patent Number: 6,106,017

[45] Date of Patent: Aug. 22, 2000

[54] BASEBALL CALENDAR

[76] Inventor: Albert M. Johnson, 9512 W. Wesley Dr., Lakewood, Colo. 80227

[21] Appl. No.: 09/451,391

[22] Filed: Nov. 30, 1999

Related U.S. Application Data

[60] Provisional application No. 60/110,181, Nov. 30, 1998.

[51] Int. Cl.[7] ..... B42D 5/04

[52] U.S. Cl. ..... 283/2; 40/107

[58] Field of Search ..... 283/2, 3, 4; 40/107, 40/120

[56] References Cited

U.S. PATENT DOCUMENTS

| | | | |
|---|---|---|---|
| 1,018,641 | 2/1912 | Strayer | 284/4 |
| 4,201,405 | 5/1980 | Rannenberg | 283/4 |
| 5,538,288 | 7/1996 | Heath . | |
| 5,768,812 | 6/1998 | Cross | 283/2 X |

*Primary Examiner*—Willmon Fridie, Jr.
*Attorney, Agent, or Firm*—Kyle W. Rost

[57] ABSTRACT

A three dimensional calendar display structure, generally resembling a ball, is formed and assembled from sheet stock. First and second regular hexagon facets provide stable bases at opposite ends of the structure, while first and second annular courses of isosceles pentagon facets, each lying along the perimeter of one of the hexagon facets, form an intermediate body of the display structure. The first and second courses are in opposed positions with the apex of each pentagon facet of one course in a position juxtaposed between apex edges of two different neighboring pentagon facets of the other course. Calendar indicia are displayed on the pentagon facets, enduring indicia are displayed on the hexagon facets, and portions of the figure 8 seam pattern and stitching of a baseball are displayed on selected facets such that the continuous figure 8 pattern is displayed on the assembled display structure.

15 Claims, 3 Drawing Sheets

BASEBALL CALENDAR

This application claims benefit of Provisional Appl. 60/110,181 filed Nov. 30, 1998.

TECHNICAL FIELD

The invention generally relates to printed matter and calendars. The invention also generally relates to card, picture, or sign exhibiting, especially to calendars and to calendars on a clerical desk article. In another aspect, the invention generally relates to adhesive bonding and methods. More specifically, it relates to surface bonding and assembly with permanent bending or reshaping or surface deformation of self-sustaining lamina. Still more specifically, it relates to reshaping by folding.

BACKGROUND ART

Calendars provide a display of sequential time periods, usually days, weeks, months, and years, in an organized format. While a full calendar might be printed with all periods on a single sheet, frequently calendar periods are presented on separate sheets or separate displays that together define the calendar. For example, a calendar may display each period, i.e., day, week, or month, on a separate page, so that the page can be changed at the end of the displayed period. For such displays, calendars are assembled into books, tablets, or like assemblies with removable or turnable pages.

A calendar can be displayed or exhibited on a supporting article such as a paper weight, pen, or desk blotter. The method of display may offer advantages in allowing reference to other periods. For example, a three dimensional calendar block or cube is shown in U.S. Pat. No. 5,538,299, formed of cut and folded paper. The six exposed facets of the block each respectively carry a one month calendar, together simultaneously displaying six months of the year. Another six months are displayed on the opposite faces of the cube walls, requiring that the cube be disassembled and then reassembled in inverted form in order to view the second group of months. While this calendar covers a full year, only one six month period of the year is displayed at one time with convenience. Using such a calendar would be especially inconvenient for referral between months on opposite faces of the folded construction. This limitation is inherently tied to the block design and the limited number of faces that can be displayed simultaneously.

A calendar can offer multiple benefits and functions. For example, a calendar can offer both utility and aesthetic enjoyment. The display of calendar information in novel ways helps draw attention to the calendar and may cause it to be used more frequently than another, less novel calendar. A calendar also can advertise and promote. It is common for a promotional calendar to feature significant promotional dates, such as the game days for a sports team. Likewise, advertising and promotional activities can be combined, such as when sports team game calendar carries advertisements from another business. Still further, novel and aesthetically pleasing calendars can be combined with promotional and advertising activities.

It would be desirable to combine a calendar with novel three dimensional designs such that the calendar and the design could provide mutual aesthetic enhancements.

Further, it would be desirable to provide a three-dimensional calendar with a physical indexing feature for predictably locating different period displays.

Still further, it would be desirable to provide a multi-faceted three-dimensional display in which each period is simultaneously displayed on a separate facet.

Another desirable improvement would provide a multi-faceted display having facets of at least two distinct geometric shapes, in which the shape of the facet correlates with its display and function.

To achieve the foregoing and other objects and in accordance with the purpose of the present invention, as embodied and broadly described herein, the calendar of this invention may comprise the following.

DISCLOSURE OF INVENTION

Against the described background, it is therefore a general object of the invention to provide an improved calendar that displays each period on a separate facet of a multi-faceted display.

Another object is to provide the combination of a calendar with a three-dimensional support, in which the design of the support and the periods of the calendar are integrated into an indexed system for display and location of desired calendar periods.

Still another object is to provide a volume efficient, low cost sheet stock material, pre-marked with both design indicia and calendar period indicia, that can be assembled into a three-dimensional display article that occupies a greater volume than the unformed stock material.

Additional objects, advantages and novel features of the invention shall be set forth in part in the description that follows, and in part will become apparent to those skilled in the art upon examination of the following or may be learned by the practice of the invention.

According to the invention, a three dimensional calendar display structure is constructed of components including first and second hexagon facets that each provide six perimeter edges. First and second courses of pentagon facets, each consisting of six pentagons, surround the respective perimeters of the first and second hexagon facets. Each pentagon facet provides a perimeter defined by a base edge, two side edges extending respectively from opposite ends of the base edge, and two apex edges extending respectively from opposite side edges and coming together at an apex. Within each course, the base edge of each pentagon facet is juxtaposed to the perimeter edge of the hexagon facet that is surrounded by the respective course of pentagon facets. In addition, each side edge of each pentagon facet is juxtaposed to a side edge of a neighboring pentagon facet within the same course. The first and second courses are in opposed positions with the apex edges of each pentagon facet of one course in a position juxtaposed to the apex edges of two neighboring pentagon facets of the other course. The first and second hexagon facets lie at opposite ends of the display structure. Calendar indicia is displayed on a plurality of the pentagon facets, while enduring indicia are displayed on the hexagon facets.

According to further aspects of the invention, in a three dimensional calendar display structure, the first and second hexagon facets have the perimeter of a regular hexagon. The pentagon facets have the perimeter of an isosceles pentagon, providing two side edges that are relatively longer and the base edge and apex edges are relatively shorter. The calendar indicia displayed on the pentagon facets comprises a one month calendar on each pentagon facet. The enduring indicia displayed on the hexagon facets is a sports team schedule or an advertisement. The calendar indicia displayed on the six pentagon facets of the first course are arranged with a top of the indicia on the first course upward toward the first hexagon facet for readability with the calendar display structure resting on the second hexagon facet. The calendar indicia displayed on the six pentagon facets of the second course are arranged with a top of the indicia on the second course upward toward the second hexagon facet for reading with the calendar display structure resting on said first hexagon facet.

The accompanying drawings, which are incorporated in and form a part of the specification illustrate preferred embodiments of the present invention, and together with the description, serve to explain the principles of the invention. In the drawings:

BEST MODE FOR CARRYING OUT THE INVENTION

The invention is a three dimensional display for a calendar, especially a calendar covering twelve months with each month individually displayed. The display is sized and shaped to resemble a ball, especially a baseball. It is formed from sheet stock such as paper, plastic, fiberboard, thin metal, or cardboard. It can be constructed from a pattern blank that is sized to be cut or formed from a single sheet of letter paper, which typically is 8½ inches by 11 inches. The display accommodates a variety of needs and requirements, which arise from the combination of mentioned features. Specifically, the resemblance to a ball, the construction from sheet stock, and the display of calendar data are achieved in a single display structure. Thus, the display structure is formed of a plurality of flat fields or facets, which together define a display surface for calendar months. The facets or fields also define a pair of opposite stable bases for the steady display of the calendar months in either of two resting positions. Yet, the number, shape, and arrangement of the facets allows the display structure to resemble a ball. This resemblance may be further promoted by use of indicia resembling a seam pattern and stitching pattern of a ball cover of a preselected type of ball, especially of a baseball.

Figure 1:
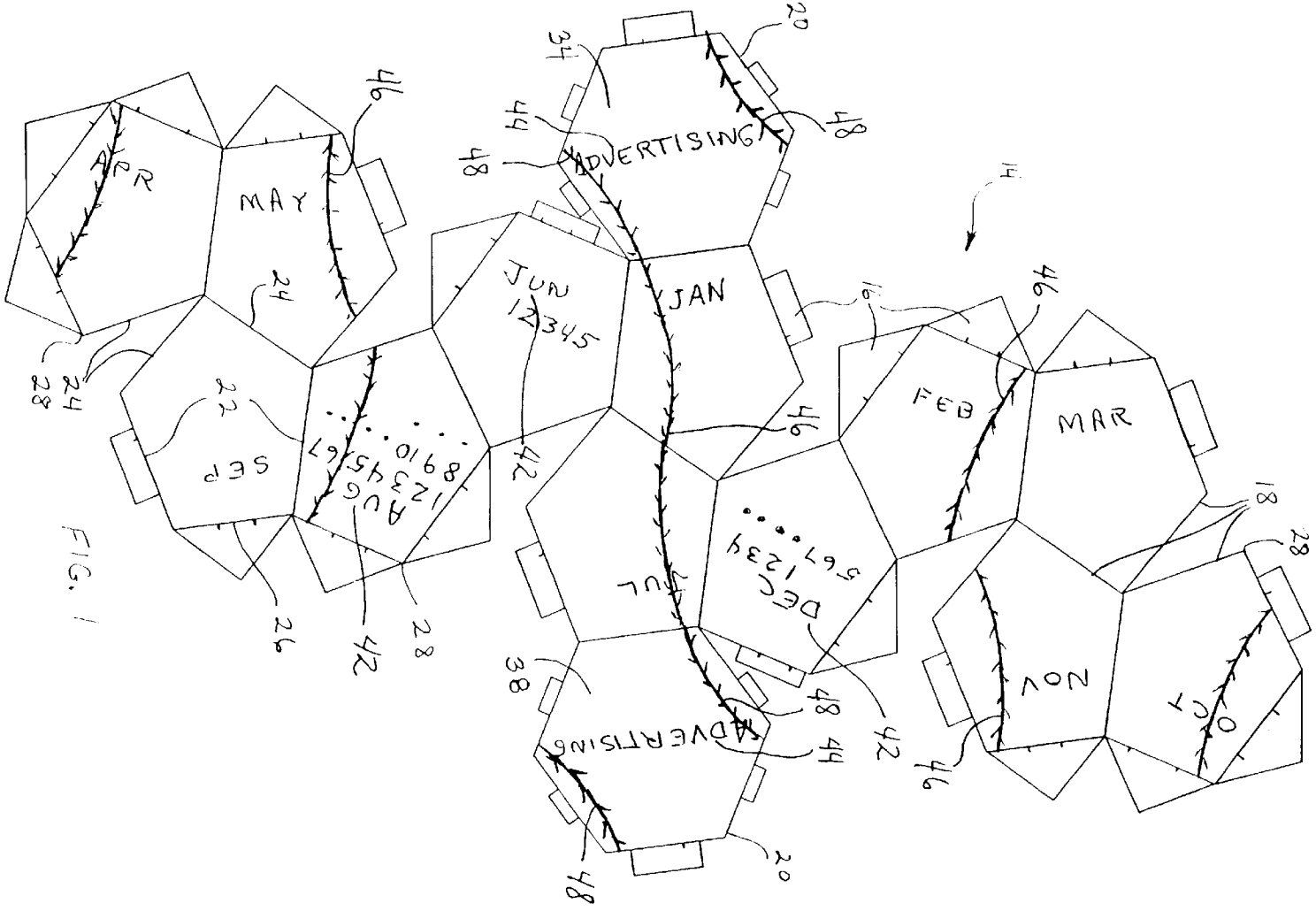
FIG. 1 is a plan view of a pattern blank for a calendar on a ball-like display.
Figure 2:
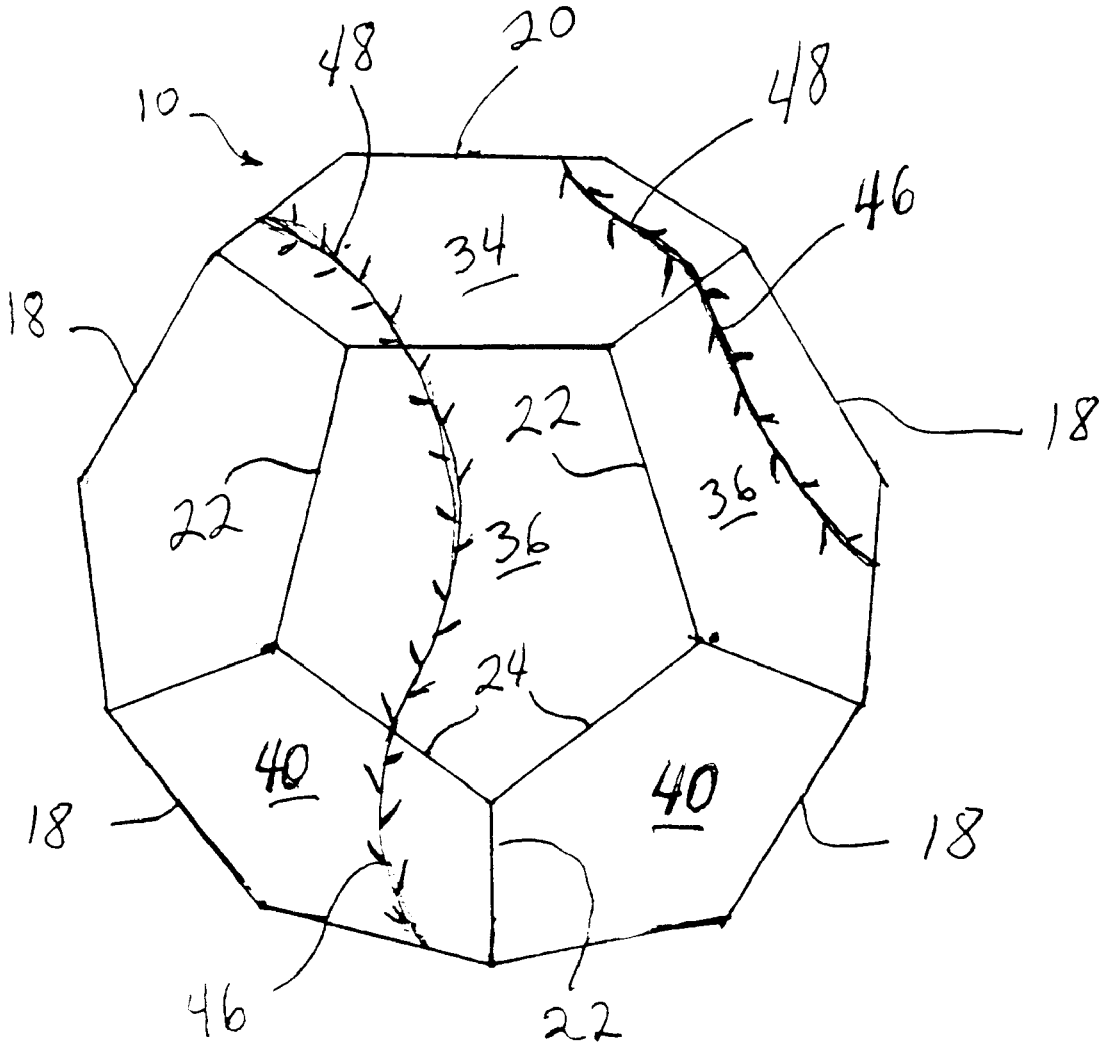
FIG. 2 is an isometric side view of the display of FIG. 1 assembled into a three-dimensional display structure.
Figure 3:
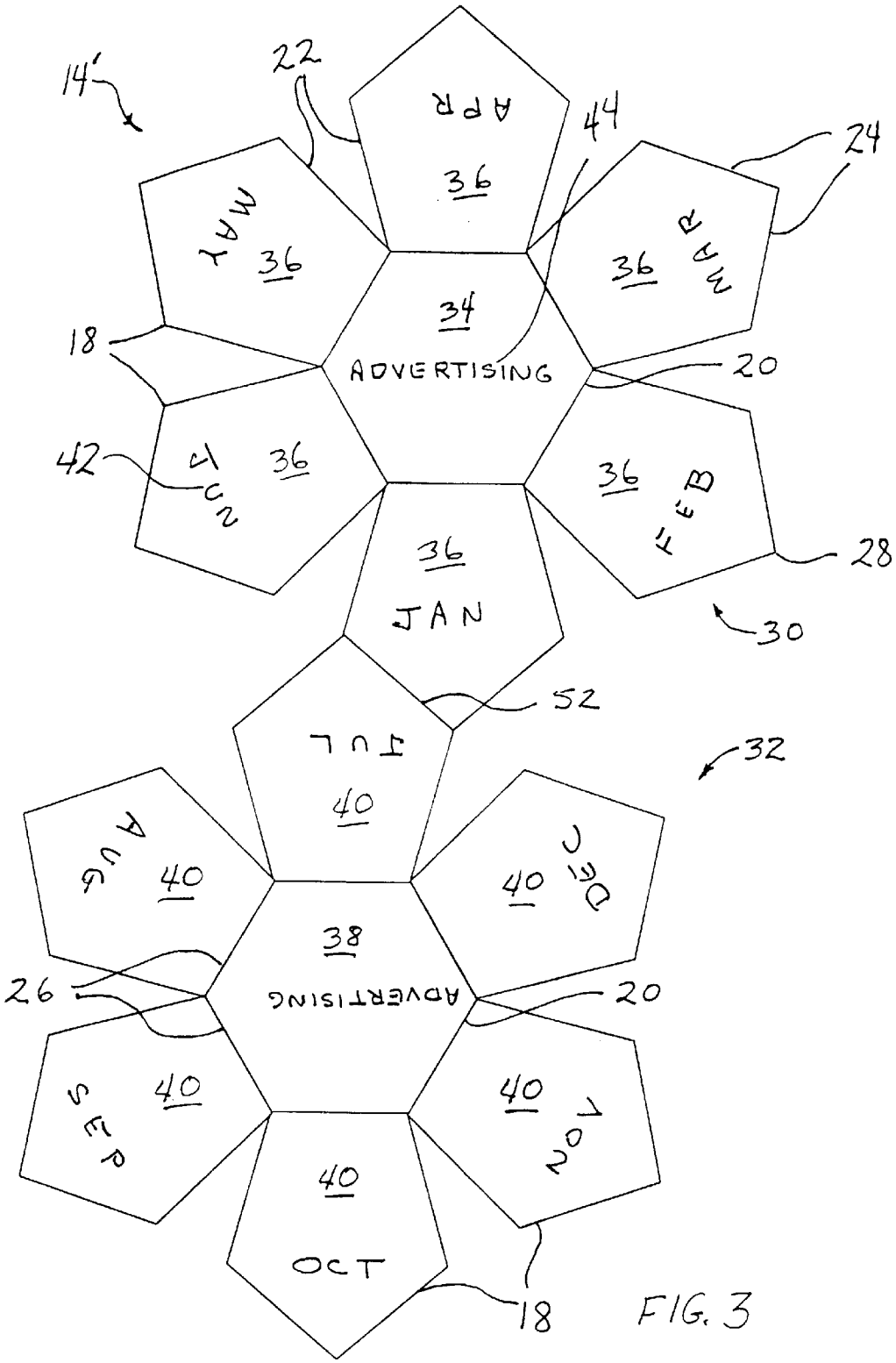
FIG. 3 is a plan view of an alternate pattern blank for a calendar on a ball-like display.

As best shown in FIG. 2, the invention provides a calendar on a three-dimensional display 10 of fourteen or more facets, collectively resembling a ball in shape. With reference to FIGS. 1 and 3, the display is created of a pattern blank 14 of a flat substrate of sheet stock. This pattern is molded, cut, severed, or otherwise shaped or folded into a three dimensional facsimile of a baseball, with the end product shown in FIG. 2. Suitable joining or assembly means 16, shown as representative tabs or flaps in FIG. 1, are provided on the edges of the facets for securing the display in three-dimensional form. Flaps may be secured with glue, adhesive tape, or other known assembly means. In addition, flaps may be omitted when a suitable clear tape is used to attach an edge of each facet to an edge of its neighbor.

The fourteen facets shown in the patterns of FIGS. 1 and 3 have respective perimeters configured as twelve equal isosceles pentagons 18 and two equal regular hexagons 20. These hexagon and pentagon shaped facets are joined together to form the closed, hollow display structure 10, FIG. 2. The surface of display structure 10, formed of the sheet stock, is substantially continuous in order to present a finished appearance, although small holes or gaps at junctions may remain. Each isosceles pentagon is formed with five edges, composed of two equal, relatively longer side edges 22 and three relatively shorter edges 24, 26, which may be equal. The side edges 22 are non-adjacent. They are separated at one end by two relatively shorter edges 24, which will be referred to as the apex edges because they meet at an apex of the pentagon shape. The side edges 22 are separated at the opposite end by a single one of the shorter edges 26, which will be referred to as the base edge. The adjacent shorter edges of a pentagon meet at apex point 28 opposite the base edge. The edges of the hexagons each are preferred to be equal in length to the base edge of a pentagon. Hence, the base edges of the pentagons may be equal to each other in length, and all edges the hexagons may be equal to each other. According to the preferred design, the base edge of each pentagon is equal in length to each of the apex edges, although the base could be relatively longer or shorter than the apex edges.

Typical or approximate suitable dimensions for the preferred construction are given for general guidance. Suitable edge dimensions are approximately 28 mm for the side edges of the pentagons and 23 mm for the base and apex edges of the pentagons and for the six edges of the hexagons. The preferred hexagon is a regular hexagon having all interior angles equal to 120°. In the pentagons, the angle between the base and a side edge is approximately 105°, between a side edge and apex edge is approximately 116–117°, and the apex angle is approximately 97–98°. Using these dimensions, it is possible to construct the display structure in its preferred form. In addition, the structure can be scaled to produce larger or smaller displays.

The overall assembly of the display structure is best described with reference to the blank of FIG. 3. The three-dimensional structure can be viewed as formed of two identical pattern halves—a first half 30 and a second half 32. Each of these halves can be assembled into a dished structure by joining adjacent side edges 22 of juxtaposed pentagons 18. The two halves are dished in the same direction, such as being concave toward the viewer. The two dished halves are joined at their open faces to form the finished sphere-like display structure of FIG. 2.

The first half 30 is centered upon a first hexagon facet 34, which serves as a first stable base and central member for the first half 30. Each edge of the first hexagon facet 34 is matched with a corresponding base edge of one of six pentagon facets 36 adjacent to it in FIG. 3, resulting in six pentagon facets 36 surrounding the perimeter of the first hexagon facet 34. In order to assemble the first half 30, the six pentagon facets 36 around hexagon facet 34 are folded toward a single side of hexagon facet 34, such as upwardly from the plane of FIG. 3, until the side edges 22 of neighboring pentagon facets touch. The touching side edges 22 are fastened together, such that the first hexagon facet and the six pentagon facets adjacent to the first hexagon facet define a generally dished shape, resembling approximately a half sphere. These first six pentagons may be referred to as the first course of pentagons facets.

The second half 32 of the assembled structure is similar, formed around a second hexagon facet 38 that serves as both a second stable base and as the central member of the second half. In order to assemble the second half 32, six pentagon facets 40 around hexagon facet 38 are folded toward a single side of hexagon facet 38, such as upwardly from the plane of FIG. 3, until the side edges 22 of neighboring pentagons touch. As in the first half, the touching side edges 22 are fastened together, such that the second hexagon facet 38 and the six pentagons 40 adjacent to the second hexagon facet define a generally dished shape, resembling approximately a half sphere. These second six pentagon facets 40 may be referred to as the second course of pentagon facets.

The two dished halves are placed together, concave face toward concave face, to define the overall display structure 10. The resulting shape resembles a full sphere, although instead of being round, it is formed of the aforementioned fourteen flat facets. The apex of each pentagon facet 36 of the first course nests between the apex edges two neighboring pentagon facets 40 of the second course, and vice versa. The assembled structure can be viewed as providing two stable bases as embodied in the two hexagons facets 34, 38, which are diametrically opposed or at opposite, top and bottom positions in the three-dimensional calendar display structure 10.

Each facet of the display may carry indicia of one, two, or three types. A first type of indicia is calendar data 42. The preferred data are twelve months of a year. Each of the twelve pentagon facets bears calendar indicia 42 of a respective one of the twelve months of a year. The name of each month is accompanied by a display of the calendar days of the selected month for the selected year chosen to be represented by the calendar. With reference to the assembled display as viewed in FIG. 2, the six pentagons 36 of the first, upper course may carry indicia of the first six months of the year, positioned to be read upright when the display is positioned with the first hexagon facet 34 at the top, such as when the display is resting upon the second hexagon facet 38. The six pentagons 40 of the second, lower course may carry indicia of the second six months of the year, positioned to be read upright when the display is positioned with the second hexagon facet 38 at the top, such as when the display is resting upon the first hexagon facet 34. Thus, the entire twelve months of a year are simultaneously displayed. Any month can be viewed by suitably rotating the calendar structure. Either grouping of six months, as respectively arranged on the first and second courses of pentagons, can be displayed in stable position by positioning the calendar structure on a flat surface, resting upon either the first or second hexagon facet.

Second indicia are enduring indicia 44 that may include commercial or promotional messages. An enduring indicia 44 is any indicia having prolonged significance, typically lasting beyond the calendar period a single pentagon facet. For example, a baseball team logo or a team color may have interest throughout a sports season, lasting several months. FIG. 1 provides another example by showing the word, "advertising," which, in practice, would be replaced by an advertising message. In other examples, the message might be an advertisement from a sponsor, a wafer-style clock, or a baseball schedule. The hexagon facets provide a preferred location of such enduring messages, since one of the two hexagon facets is displayed in a visible, top position, when the opposite facet is serving as a stable base. It could be anticipated each hexagon facet would be displayed for six months, which substantially exceeds a one month period likely to be shown on one pentagon facet. Thus, the two hexagon facets serve multiple functions as stable bases, carrying an enduring message or display, and structurally completing the three-dimensional calendar.

A third and optional type of indicia 46 is suggestive of a type of ball, such as a baseball. The pattern blank 14 of FIG. 1 shows a preferred orientation of indicia 46 suggesting a stitched joining line of a cover of a baseball. Such a cover employs two cover pieces, each having a generally symmetrical outline similar to the number "8." Thus, each has a narrow waist between opposite, generally circular areas of covering material. The two described cover pieces are wrapped around the core of each baseball at 90° rotation such that the circular areas of one piece nest into the waist area of the other piece. The seam lines between the two cover pieces are stitched with thread.

This seam and stitching pattern, which may be referred to as a "figure 8" pattern, is imitated on the display structure 10, which shows both the pattern of the "figure 8" edges and a pattern of stitch lines closing the edges. In the pattern for the calendar display structure, each hexagon facet displays indicia 48 representing a symmetrical narrow waist of the figure 8 edge pattern of a cover piece, including indicia of twin stitching lines. The two opposite edges of the stitched waist pattern 48 symmetrically pass near opposite edges of each hexagon facet. With the stitching of the figure 8 waists arranged in these positions, the remainder of the stitching pattern is well oriented for clear display on the pentagon facets.

The design of a baseball is suggested by indicia 46 of the seam and stitching line following a traditional figure 8 pattern around the display. Portions of the seam line appear on a plurality of facets of the display, other than four pentagon facets, according to the arrangement proposed in FIGS. 1 and 2 of the drawings. Other relative positioning is possible. In each arrangement, the individual segments of the stitched seam pattern, as located on selected fields or facets, become united in the assembled display structure to form a continuous figure 8 pattern extending around the assembled display structure. Other baseball indicia, which may be enduring indicia 44, may appear on the display, such as appropriate color, team identification, league identification, special game or event identification, and the like.

The display structure is formed of sheet stock defining a pattern blank 14,14' for assembling the display 10. The pattern may follow a variety of schemes. The scheme 14 of FIG. 1 is preferred for providing good structural strength characteristics while being compact enough to employ a single sheet of sheet stock such as paper. According to this pattern, twelve pentagons are joined in sequence, which may be a linear series. The pentagons are joined in an alternating pattern of juxtaposed pentagons joined by either side edges and apex edges. In the linear sequence, the pentagons are joined in the series as sequential pairs. A pair, such as the first and second pentagons in series, are joined to each other at side edges with both apexes generally aligned in one direction, pointing generally in the direction of the next pair. Sequential pairs are interconnected at apex edges. Each of the two hexagons is connected to a base edge of a respective one of the center two pentagons, each of which is in a different pair, placing the hexagons on opposite sides of the linear sequence of pentagons. Clearly, it would be equivalent to join the hexagons to any pentagons of the pattern, with each hexagon on an opposite sides of the sequence.

In FIG. 1, each pentagon 18 is provided with one or more joining means 16, while each hexagon 20 is provided with five such joining means 16. Each joining means 16 extends from a free edge of its associated facet and may be coded for use by its shape to be either an insertion tab or a slotted tab. For example, the insertion tabs are rectangular, while the slotted tabs are triangular. Each slotted tab carries a slot structure at its border with the pentagon 18 or hexagon 20. The slots and tabs are coordinated in size to snugly engage. The assembled display structure 10 is of suitable size for viewing while approximating the size of a baseball.

In the alternate pattern shown in FIG. 3, each hexagon 20 is arranged in the center of a ring of six pentagons 18, connected to each pentagon at a base edge. The facets of the upper ring, according to the view of FIG. 3, may be the first course of pentagon facets, while the lower ring may be the second course. In this pattern, the first and second courses are joined at one common edge 52 between a pentagon of the first course and a pentagon of the second course. A suitable joining means, similar to FIG. 1, can be adapted to this pattern, or junctions can be secured by clear tape.

The pattern blank 14 provides fields included within each hexagon or pentagon, which can be printed with the various indicia of this invention. All indicia are printed on a single side of the blank. When the display structure is assembled, the selected single side carrying the indicia is the outside of the three-dimensional structure 10. Thus, the months of an entire year are displayed on the outside of the structure. It is within the invention to provide indicia on both side of the pattern blank 14, such as calendar indicia of two sequential years located with one year on each side of the pattern blank. A likely purpose of providing such dual indicia is to offer a choice of which side will be displayed on the final assembly. Thus, a single printing run of large volume can provide a product of longer useful life. For example, such a calendar could be offered over a two year period. The user could assemble the display structure to display whichever side is selected.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be regarded as falling within the scope of the invention as defined by the claims that follow.

I claim:

1. A three dimensional calendar display structure, comprising:

first and second hexagon facets, each having a perimeter providing six perimeter edges;

first and second courses of pentagon facets, each course consisting of a ring of six pentagons, each pentagon facet having a perimeter providing a base edge, two side edges extending respectively from opposite ends of said base edge, and two apex edges extending respectively from opposite side edges and coming together at an apex opposite the base edge;

wherein said first course encircles the perimeter of said first hexagon facet with the base edge of each pentagon facet juxtaposed to a respective one of said perimeter edges of the first hexagon facet, and within the first course each side edge of each pentagon facet is juxtaposed to a side edge of a neighboring pentagon facet;

wherein said second course encircles the perimeter of said second hexagon facet with the base edge of each pentagon facet juxtaposed to a respective one of said perimeter edges of the second hexagon facet, and within the second course each side edge of each pentagon facet is juxtaposed to a side edge of a neighboring pentagon facet;

wherein the first and second courses are in opposed positions with the apex edges of each pentagon facet of one course in a position juxtaposed to the apex edges of two neighboring pentagon facets of the other course, and the first and second hexagon facets lie in opposed positions within the display structure; and calendar indicia displayed on a plurality of the pentagon facets.

2. The three dimensional calendar display structure of claim 1, wherein the perimeter of said first and second hexagon facets is a regular hexagon.

3. The three dimensional calendar display structure of claim 1, wherein the perimeter of said pentagon facets is an isosceles pentagon wherein said two side edges are relatively longer and said base edge and apex edges are relatively shorter.

4. The three dimensional calendar display structure of claim 1, wherein said calendar indicia displayed on said pentagon facets comprises a one month calendar on each pentagon facet.

5. The three dimensional calendar display structure of claim 1, further comprising enduring indicia displayed on said hexagon facets.

6. The three dimensional calendar display structure of claim 5, wherein said enduring indicia displayed on said hexagon facets comprises a sports team schedule.

7. The three dimensional calendar display structure of claim 1, wherein said enduring indicia displayed on said hexagon facets comprises an advertisement.

8. The three dimensional calendar display structure of claim 1, wherein:

said calendar indicia is displayed on said first course with one month on each pentagon facet thereof and is positioned thereon with a top of the indicia upward toward said first hexagon facet for upright reading with the calendar display structure resting on said second hexagon facet; and said calendar indicia is displayed on said second course with one month on each pentagon facet thereof and is positioned thereon with a top of the indicia upward toward said second hexagon facet for upright reading with the calendar display structure resting on said first hexagon facet.

9. A pattern blank formed of sheet stock for assembly of a three dimensional calendar display structure that, in assembled form, defines a symmetrical sphere-like body having two flat hexagon facets at opposite ends of the structure, separated by two courses of flat pentagon facets, comprising:

first and second regular hexagons, each having a central included field and each having a perimeter providing six equal perimeter edges; and twelve isosceles pentagons, each having a central included field, each having a perimeter providing five perimeter edges consisting of two non-adjacent side edges of relatively longer length, equal to each other, having first and second opposed ends; and three relatively shorter edges, wherein one of said shorter edges is a single base edge equal in length to a perimeter edge of one of said hexagons and located between the first ends of said side edges, and two of the shorter edges are apex edges, adjacent to each other, located between the second ends of the side edges and forming an apex located opposite from said base edge;

wherein each of said hexagons is joined along one of said six perimeter edges to a base edge of at least one of said pentagons; and wherein at least a first one of said pentagons is joined to a second one of the pentagons along a single perimeter edge selected from the group consisting of a side edge or an apex edge, and the second pentagon is joined to the first pentagon along a same selected edge; and calendar indicia displayed on a field of each pentagon, on one face of the sheet stock.

10. The pattern blank of claim 9, wherein said calendar indicia comprises the twelve months of a year, displayed with one month on the field of each respective pentagon.

11. The pattern blank of claim 9, further comprising enduring indicia displayed on a field of at least one of said pentagons, on a same face of said sheet stock as said calendar indicia.

12. The pattern blank of claim 9, further comprising baseball seam indicia displayed on preselected fields of said hexagons and pentagons, in positions that define a continuous figure 8 seam pattern in the assembled display structure.

13. The pattern blank of claim 12, wherein said seam indicia is arranged with two seam indicia, corresponding to two sides of a waist of a figure 8 seam pattern, located on each of said hexagon fields.

14. A pattern blank of claim 9, wherein at least one of said hexagons is joined to six of said pentagons, with the base edge of each of the six pentagons joined to said hexagon along a respective perimeter edge of the hexagon.

15. A pattern blank of claim 9, wherein said twelve pentagons are joined in an alternating sequence consisting of juxtaposed pentagons joined at said side edges and joined at said apex edges.

* * * * *